US009121290B2

(12) United States Patent
Jenne et al.

(10) Patent No.: US 9,121,290 B2
(45) Date of Patent: Sep. 1, 2015

(54) TURBINE AIRFOIL WITH BODY MICROCIRCUITS TERMINATING IN PLATFORM

(75) Inventors: Douglas C. Jenne, West Hartford, CT (US); Matthew S. Gleiner, Vernon, CT (US); Matthew A. Devore, Cromwell, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 871 days.

(21) Appl. No.: 12/774,771

(22) Filed: May 6, 2010

(65) Prior Publication Data

US 2011/0274559 A1 Nov. 10, 2011

(51) Int. Cl.
*F01D 5/18* (2006.01)

(52) U.S. Cl.
CPC ..... *F01D 5/187* (2013.01); *F05D 2240/81* (2013.01); *F05D 2260/204* (2013.01); *Y10T 29/49341* (2015.01)

(58) Field of Classification Search
CPC ..... F01D 5/186; F01D 5/187; F01D 5/18; F01D 5/081; F01D 25/12; F05D 2260/202; F05D 2260/204; F05D 2240/81; Y10T 29/49341
USPC ..... 416/95, 96 R, 97 R
See application file for complete search history.

(56) References Cited

U.S. PATENT DOCUMENTS

| | | | | |
|---|---|---|---|---|
| 6,354,797 | B1 * | 3/2002 | Heyward et al. | 415/191 |
| 2006/0093480 | A1 * | 5/2006 | Cunha et al. | 416/97 R |
| 2007/0116569 | A1 * | 5/2007 | Cunha et al. | 416/97 R |
| 2007/0177976 | A1 * | 8/2007 | Cunha et al. | 416/97 R |
| 2008/0008599 | A1 * | 1/2008 | Cunha et al. | 416/97 R |
| 2008/0163604 | A1 * | 7/2008 | Spangler | 60/39.83 |
| 2008/0166240 | A1 * | 7/2008 | Scott et al. | 416/232 |
| 2009/0324425 | A1 * | 12/2009 | Hudson | 416/97 R |

FOREIGN PATENT DOCUMENTS

| | | | |
|---|---|---|---|
| EP | 1882816 | A2 | 1/2008 |
| EP | 1882819 | A1 | 1/2008 |
| GB | 768247 | A | 2/1957 |

* cited by examiner

*Primary Examiner* — Dwayne J White
*Assistant Examiner* — Joshua R Beebe
(74) *Attorney, Agent, or Firm* — Bachman & LaPointe, P.C.

(57) ABSTRACT

A turbine engine component includes a platform and one or more microcircuit cooling passages embedded within one or more walls of an airfoil portion of the component. Each microcircuit cooling passage terminates within the thickness of the platform so as to provide cooling to the initial 10% span of the airfoil portion. Each microcircuit cooling passage has an inlet for receiving cooling fluid, which inlet is also embedded within the platform.

12 Claims, 5 Drawing Sheets

TURBINE AIRFOIL WITH BODY MICROCIRCUITS TERMINATING IN PLATFORM

STATEMENT OF GOVERNMENT INTEREST

The Government of the United States of America may have rights in the present invention as a result of Contract No. F33615-03-D-2354-0009 awarded by the Department of the Air Force.

BACKGROUND

The present disclosure is directed to a turbine engine component having microcircuit cooling passages that cover the initial 10% span of the airfoil portion and originate in the platform and may provide up to 100% coverage along the entire airfoil.

Gas turbine engines are known and include a compressor which compresses a gas and delivers it into a combustion chamber. The compressed air is mixed with fuel and combusted, and products of this combustion pass downstream over turbine rotors.

Gas turbine engines include a compressor which compresses air and delivers it downstream into a combustion section. The air is mixed with fuel in the combustion section and ignited. Products of this combustion pass downstream over turbine rotors, which are driven to rotate. In addition, static vanes are positioned adjacent to the turbine rotors to control the flow of the products of combustion.

The turbine rotors carry blades. The blades and the static vanes have airfoils extending from platforms. The blades and vanes are subject to extreme heat, and thus cooling schemes are utilized for each.

Cooling circuits for turbine engine components have been embedded into the airfoil walls (and referred to as microcircuit cooling passages). These cooling circuits however have originated prior to the initial 10% span of an airfoil portion.

SUMMARY OF THE DISCLOSURE

In accordance with the present disclosure, there is described a microcircuit cooling passage in an airfoil portion of a turbine engine component which cools the initial 10% span of the airfoil portion to manage stress, gas flow, and heat transfer.

In accordance with the present disclosure, there is described a process for forming a turbine engine component which broadly comprises the steps of: providing a main core for forming a turbine engine component having a platform; and positioning at least one refractory metal core relative to the main core so that a terminal end of said at least one refractory metal core is located in a region where the platform is to be formed.

In accordance with the present disclosure, there is described a turbine engine component which broadly comprises: an airfoil portion having a platform, a pressure side wall, a suction side wall, and a root portion; at least one microcircuit cooling passage embedded within said pressure side wall and/or said suction side wall with one central core connected to the microcircuit cooling passage(s); and each said microcircuit cooling passage providing cooling within an initial 10% span of said airfoil portion. An inlet for the passage may also be located adjacent the initial 10% span or adjacent the platform.

Other details of a microcircuit cooling passage in an airfoil portion of a turbine engine component are set forth in the following detailed description and the accompanying drawings wherein like reference numerals depict like elements.

DETAILED DESCRIPTION OF THE PREFERRED EMBODIMENT(S)

Figure 1:
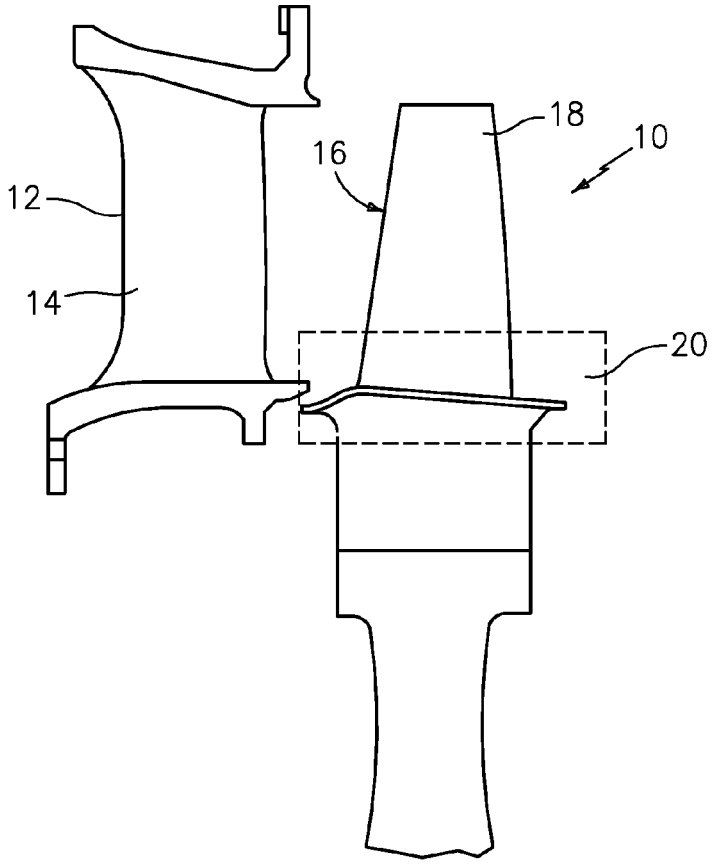
FIG. 1 is a schematic representation of a portion of a turbine engine.

FIG. 1 illustrates a portion of a turbine engine 10. As shown therein, the turbine engine 10 has a section which includes a vane 12 having an airfoil portion 14 and a blade 16 having an airfoil portion 18. The area 20 shows the area which is to be discussed herein.

Figure 2:
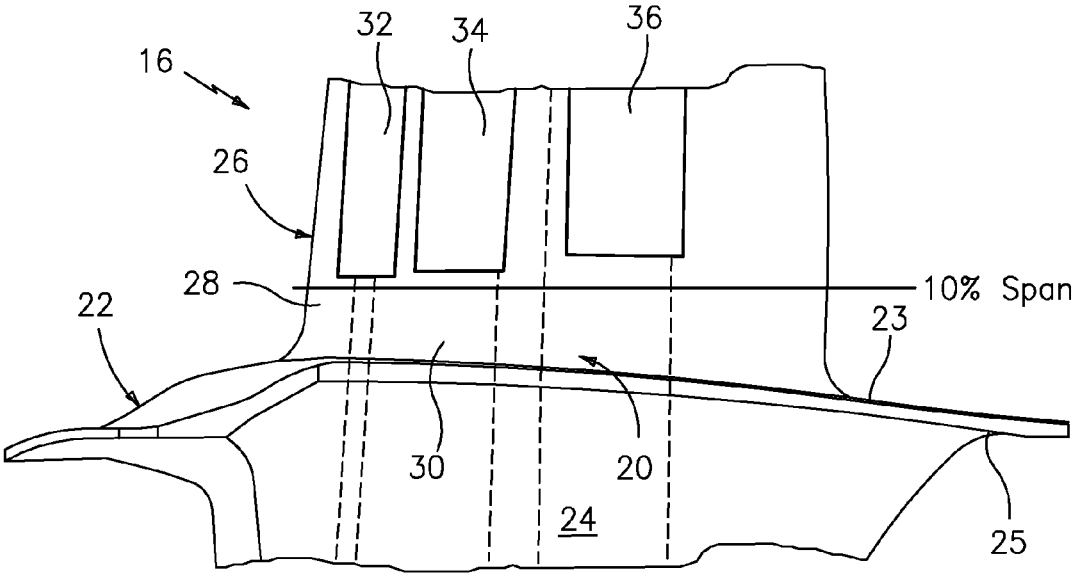
FIG. 2 is a schematic representation of a portion of a turbine blade that does not contain microcircuit cooling passages within the initial 10% span of an airfoil.

FIG. 2 illustrates a portion of a turbine blade 16. As can be seen from this figure, the blade 16 has a platform 22, a root portion 24, and an airfoil portion 26. The blade 16 has a pressure side wall 28 and a suction side wall (not shown). Between the pressure side wall 28 and the suction side wall, there are one or more cores or cavities 30 through which a cooling fluid flows. The platform 22 has an upper surface 23 and a lower surface 25.

Figure 9:
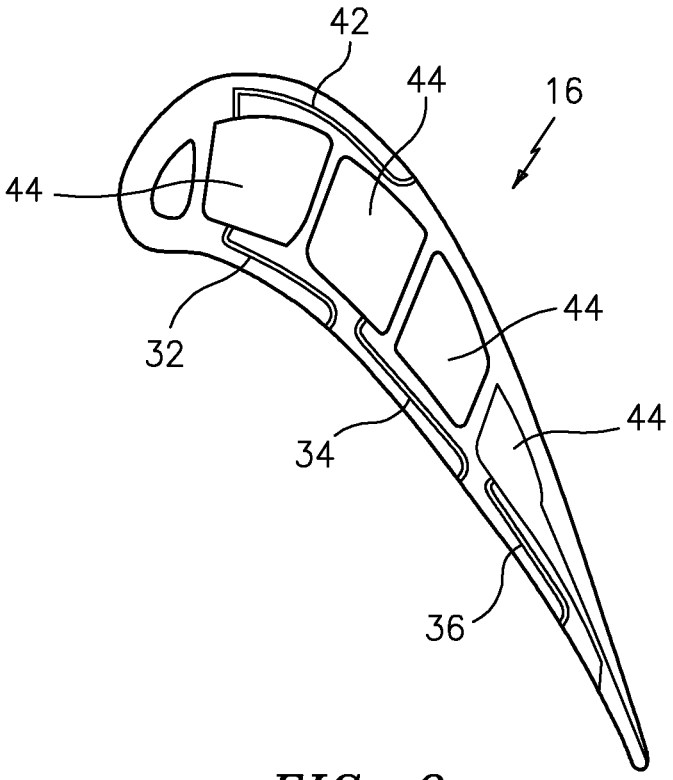
FIG. 9 is a sectional view of a turbine blade.

High heat load applications may require one or more cooling circuits or microcircuits embedded within at least one of the pressure side wall 28 and the suction side wall. These cooling circuits provide cooling and shielding from coolant heat pick-up. The cooling circuits are formed during casting by using refractory metal cores to form the passages 32, 34, and 36 shown in FIGS. 2 and 9. After the blade 16 has been cast, the cores are chemically removed, leaving the desired cooling circuits. Each of the refractory metal cores 32, 34, and 36 is fabricated so as to create a desired set of fluid passageways with or without a desired set of features such as pedestals for creating turbulence in the cooling flow. The refractory metal cores may be made out of a refractory material such as molybdenum or a molybdenum alloy.

As can be seen from FIG. 2, the region or area 20 is not covered by any portion of the microcircuit cooling passages 32, 34, and 36. Conversely, this uncovered area 20 along the airfoil root is subject to high thermal gradients.

Figure 3:
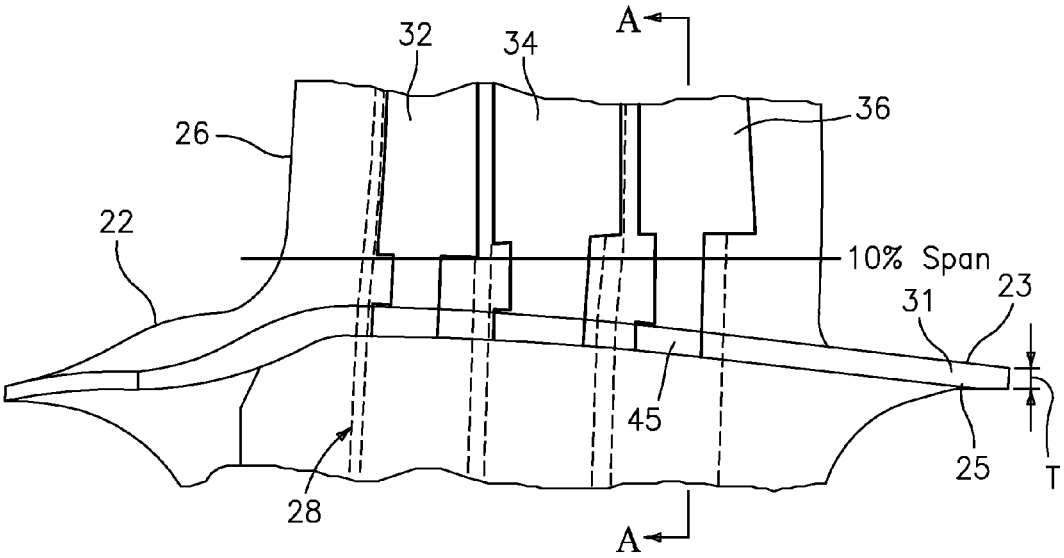
FIG. 3 is a schematic representation of a portion of a turbine blade that contains microcircuit cooling passages in the initial 10% span of the airfoil portion.

As shown in FIG. 3, improved resistance to high thermal gradients can be provided by allowing the microcircuit cooling passages 32, 34, and 36 to end in the region of the platform 22 allowing better management of stress, gas flow and heat transfer. The microcircuit cooling passages may terminate in a location 31 between the upper surface 23 and the lower surface 25 such as the mid-region of the thickness T.

Figure 4:
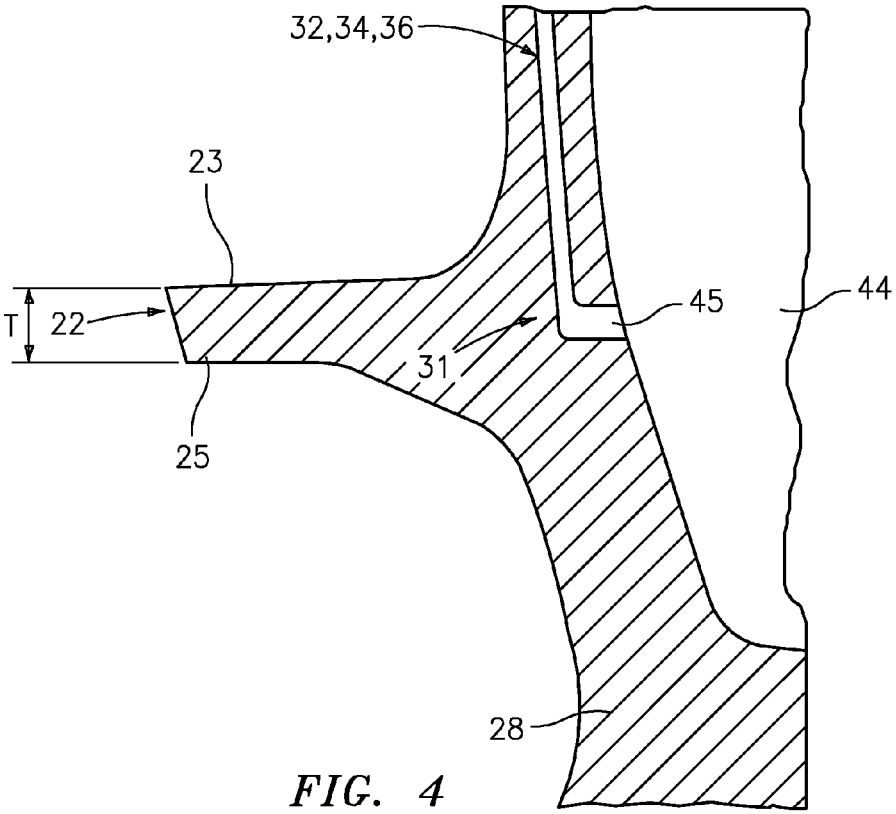
FIG. 4 is a sectional view taken along lines A-A in FIG. 3.

FIG. 4 is a sectional view of the pressure side taken along lines A-A in FIG. 3. As can be seen from this Figure, the microcircuit cooling passage(s) 32, 34 and/or 36 terminate in the vicinity of the platform 22, while being embedded within the pressure side wall 28 within the platform thickness T.

Figure 5:
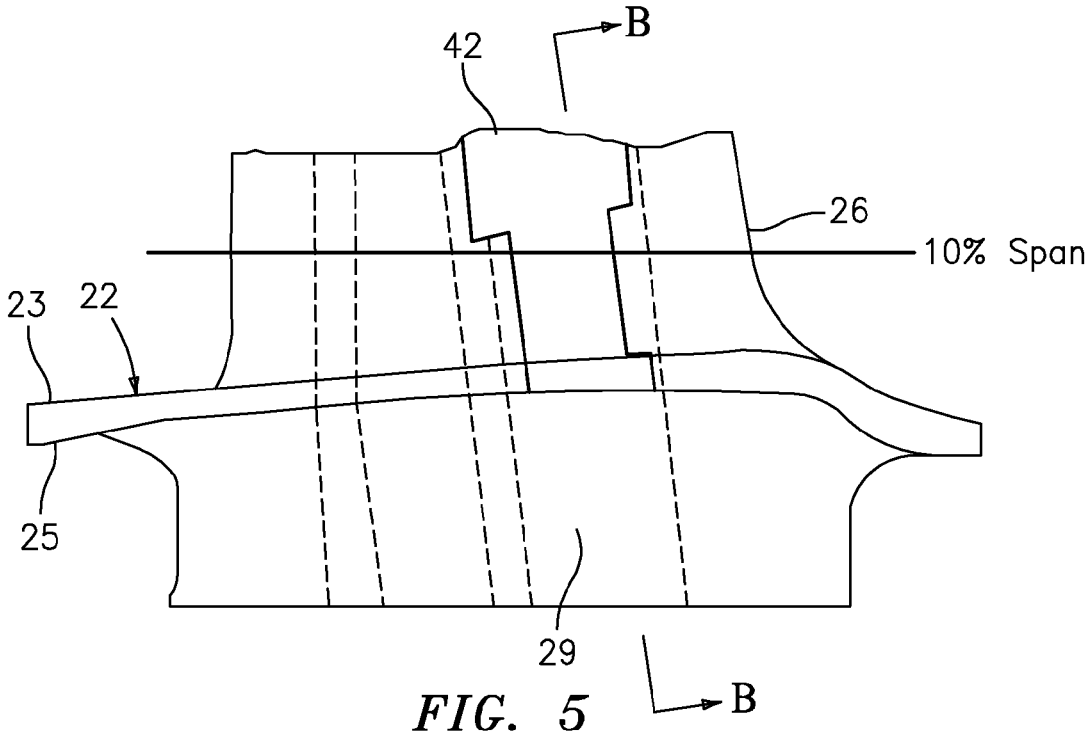
FIG. 5 is a schematic representation of the suction side of the blade of FIG. 3.
Figure 6:
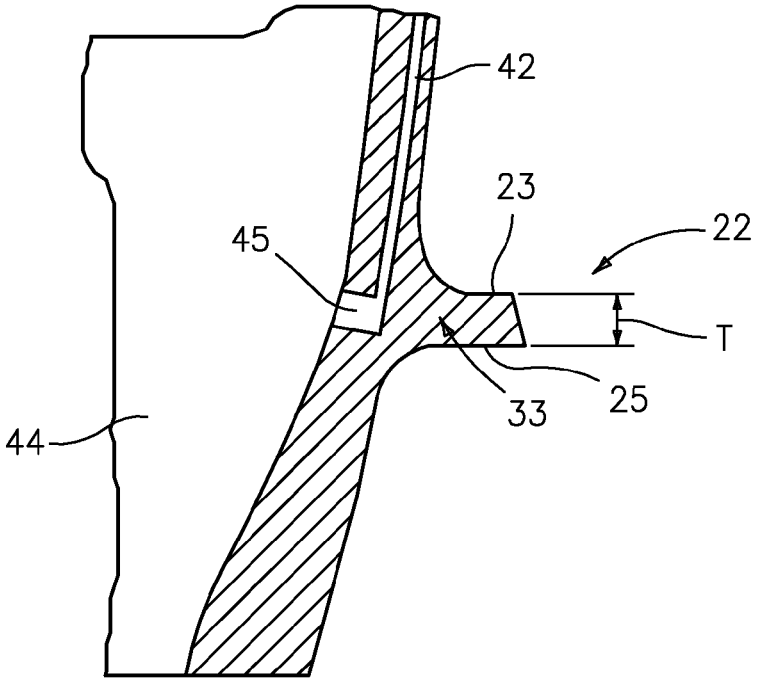
FIG. 6 is a sectional view taken along lines B-B in FIG. 5.

FIG. 5 illustrates the suction side wall 29 of a turbine blade 16. FIG. 6 is a sectional view taken along lines B-B in FIG. 5. One or more microcircuit cooling passages 42 may be embedded within the suction side wall 29. As can be seen from these figures, the cooling passage(s) 42 terminate in the vicinity of the platform 22, such as in a location 33 between the upper surface 23 and the lower surface 25 of the platform 22 within the platform thickness T.

Figure 7:
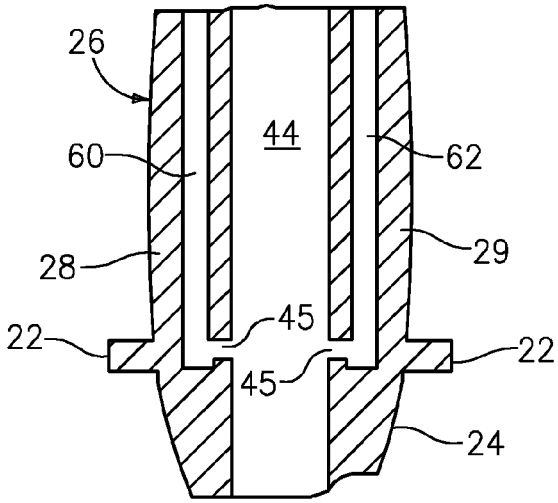
FIG. 7 is a sectional representation of a portion of a turbine blade that contains microcircuit cooling passages on both the pressure side and the suction side of an airfoil portion.

As previously discussed and as shown in FIG. 7, the turbine blade 16 has one or more central cores 44, through which cooling fluid flows. Each respective cooling circuit 60, 62 may have an inlet 45 adjacent the terminal end of the cooling circuit in the platform region of the turbine blade which fluidly connects to a respective core 44. The inlet 45 may be formed using any suitable technique known in the art, such as providing a refractory metal core with a curved configuration which forms the inlet 45.

The turbine blade 16 may be formed using a lost molding technique as is known in the art.

The microcircuit cooling passages 32, 34, 36 and 42 may be formed from a refractory metal or metal alloy such as molybdenum or a molybdenum alloy. Alternatively, each of these microcircuit cooling passages 32, 34, 36 and 42 may be formed from a ceramic or silica material. It is also to be noted that, depending on the size of the cooling passages, e.g., for larger parts and the part, the cooling passages may be formed using conventional ceramic cores in place of some or all of the metal cores.

Figure 8:
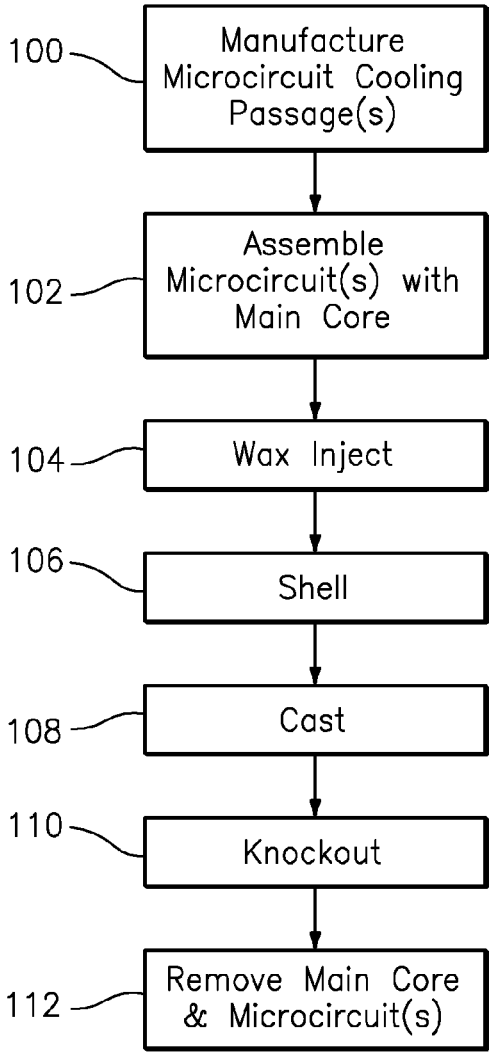
FIG. 8 is a flow chart illustrating the process for forming a turbine blade in accordance with the present disclosure.

Referring now to FIG. 8, there is shown a flow chart of a process for forming a turbine engine component. In step 100, the refractory metal cores 32, 34, 36 and 42 used to form the cooling passages are manufactured. Any suitable technique may be used to manufacture the cores. In step 102, the refractory metal cores are assembled with the main core. The refractory metal cores are positioned so that a terminal end of each refractory core is located in a region where a platform is to be formed.

In step 104, wax is injected around the assembled cores to form a wax pattern. In step 106, the wax pattern, with the cores, is dipped in a slurry which coats the wax pattern and forms a shell. After being formed, the shell is dried. The wax is then melted away to leave the shell to function as a mold.

In step 108, the turbine engine component is cast by pouring molten material into the mold/shell. The molten metal is allowed to solidify. In step 110, the turbine engine component with the cores is removed from the mold. In step 112, the main core and the refractory metal cores are removed. The cores may be removed using any suitable technique known in the art.

While the process of the present disclosure has been described in the context of microcircuit cooling passages in an unshrouded turbine blade, the same process and features may also be used for microcircuit cooling passages in other turbine engine components such as static vanes and shrouded blades.

It is apparent that there has been provided a microcircuit cooling passage in an airfoil portion of a turbine engine component. While the present process has been described in the context of specific embodiment(s) thereof, unforeseen alternatives, variations, and modifications may become apparent to those skilled in the art having read the foregoing description. It is intended to embrace those alternatives, modifications, and variations as fall within the broad scope of the appended claims.

What is claimed is:

1. A turbine engine component comprising:

An airfoil portion having a platform, a pressure side wall, a suction side wall, and a root portion;

said platform having an upper surface and a lower surface;

at least one microcircuit cooling passage embedded within and extending into at least one of said pressure side wall and said suction side wall; said at least one microcircuit cooling passage being collinear with at least one of said pressure side wall and said suction side wall; said at least one microcircuit cooling passage terminating in a location between said upper surface and said lower surface, wherein said platform has a thickness and each said microcircuit cooling passage terminates at a mid-region of said thickness;

at least one central core;

each said microcircuit cooling passage having an inlet at an angle to said microcircuit cooling passage which communicates with said at least one central core and with said terminating location of said at least one microcircuit cooling passage, wherein said inlet is located in the mid-region of said thickness; and each said microcircuit cooling passage providing cooling within an initial 10% span of said airfoil portion.

2. The turbine engine component according to claim 1, wherein said at least one microcircuit cooling passage is embedded within the pressure side wall.

3. The turbine engine component according to claim 1, wherein said at least one microcircuit cooling passage is embedded within the suction side wall.

4. The turbine engine component according to claim 1, wherein the at least one cooling circuit includes a first microcircuit cooling passage embedded within the suction side wall and a second microcircuit cooling passage embedded within the pressure side wall.

5. The turbine engine component according to claim 1, wherein said inlet is embedded within said platform and is located between said upper surface and said lower surface of said platform.

6. The turbine engine component according to claim 1, wherein said at least one microcircuit cooling passage extends away from said inlet beyond said initial 10% span of said airfoil portion.

7. A process for forming a turbine engine component comprising the steps of:

providing a main core for forming a turbine engine component having a platform;

providing at least one refractory metal core configured to form a cooling microcircuit in an airfoil portion of said turbine engine component;

positioning said at least one refractory metal core relative to said main core so that a terminal end of said at least one refractory metal core is located in a region where said platform is to be formed, said cooling microcircuit extends away from said terminal end beyond an initial 10% span of said airfoil portion; and wherein said positioning step comprises positioning said at least one refractory metal core so that each said refractory metal core terminates in a mid-region of a thickness of the platform, said refractory metal core placement resulting in an inlet to the circuit formed by said refractory metal core, also positioned in said mid-region of the thickness of the platform.

8. The process of claim 7, wherein said positioning step comprises positioning a plurality of refractory metal cores relative to said main core so that a terminal end of each said refractory metal core is located in a region where said platform is to be formed.

9. The process of claim 7, wherein said positioning step comprises positioning said at least one refractory metal core in a location where said at least one refractory metal core becomes embedded within a pressure side wall of said turbine engine component.

10. The process of claim 7, wherein said positioning step comprises positioning said at least one refractory metal core in a location where said at least one refractory metal core becomes embedded within a suction side wall of said turbine engine component.

11. The process of claim 7, further comprising forming at least one cooling circuit by removing said at least one refractory metal core.

12. The process of claim 11, further comprising removing said main core after said turbine engine component has been cast.

* * * * *